US006272778B1

(12) United States Patent
Tang

(10) Patent No.: US 6,272,778 B1
(45) Date of Patent: Aug. 14, 2001

(54) DISPLAY ELEMENT FOR ELECTROMAGNETIC DISPLAYS

(75) Inventor: Joseph Tang, Richardson, TX (US)

(73) Assignee: Lite Vision, Inc, Richardson, TX (US)

( * ) Notice: Subject to any disclaimer, the term of this patent is extended or adjusted under 35 U.S.C. 154(b) by 0 days.

(21) Appl. No.: 09/375,332

(22) Filed: Aug. 16, 1999

(30) Foreign Application Priority Data

Jan. 27, 1999 (EP) ..... 99101452

(51) Int. Cl.[7] ..... G09F 3/04; G09F 9/302
(52) U.S. Cl. ..... 40/449; 340/815.62; 40/452
(58) Field of Search ..... 40/449, 451, 452; 340/815.53, 815.54, 815.55, 815.62, 815.45; 345/111

(56) References Cited

U.S. PATENT DOCUMENTS

| | | | | |
|---|---|---|---|---|
| 3,295,238 | * | 1/1967 | Winrow | 40/449 |
| 4,531,318 | | 7/1985 | Chang et al. | 40/449 |
| 4,577,427 | * | 3/1986 | Browne | 40/449 |
| 4,860,470 | * | 8/1989 | Browne | 40/449 |
| 5,005,305 | | 4/1991 | Turney et al. | 40/449 |
| 5,055,832 | | 10/1991 | Browne | 40/449 X |
| 5,771,616 | * | 6/1998 | Tijanic | 40/449 X |
| 5,809,675 | * | 9/1998 | Tijanic et al. | 40/449 |
| 5,901,483 | * | 5/1999 | Tijanic | 40/449 |
| 5,909,971 | * | 6/1999 | Tijanic | 40/449 |
| 5,933,329 | * | 8/1999 | Tijanic et al. | 40/449 X |
| 6,025,825 | * | 2/2000 | Kao | 40/449 X |
| 6,111,759 | * | 8/2000 | Tijanic et al. | 40/449 X |

FOREIGN PATENT DOCUMENTS

EP 0 247 045 4/1990 (DE) .

* cited by examiner

*Primary Examiner*—Joanne Silbermann
(74) *Attorney, Agent, or Firm*—Chadbourne & Parke LLP

(57) ABSTRACT

Display element for an electromagnetic display device comprising a frame and a disc mounted to the frame for pivoting of the disc about a pivoting axis, the disc having two differently colored sides, an ON-side the color of which contrasts against the background color of the frame and an OFF-side having a non-contrasting color. An electromagnetic drive system drives the disc from a first operating position where its ON-side is directed towards the main viewing direction to a second operating position where its OFF-side is directed towards the viewing direction. The drive system comprises a permanent magnet attached to the disc and an electromagnet attached to the frame. A reliable operation with a reduced production cost is achieved by a combination of features, wherein two portions of the disc extend in a disc plane on both sides of the pivoting axis, the permanent magnet is attached to the disc and extends across the pivoting axis, the turning angle of the disc is less than 180°, the magnetic drive system has a single electromagnet and a driving tip of its ferromagnetic core is located sidewise of the pivoting axis such that in each of the operating positions one of the poles of the permanent magnet is directed towards the driving tip and the driving tip is in one of the operating positions rearward and in the other of the operating positions forward relative to the disc plane.

17 Claims, 3 Drawing Sheets

DISPLAY ELEMENT FOR ELECTROMAGNETIC DISPLAYS

Figure 1:
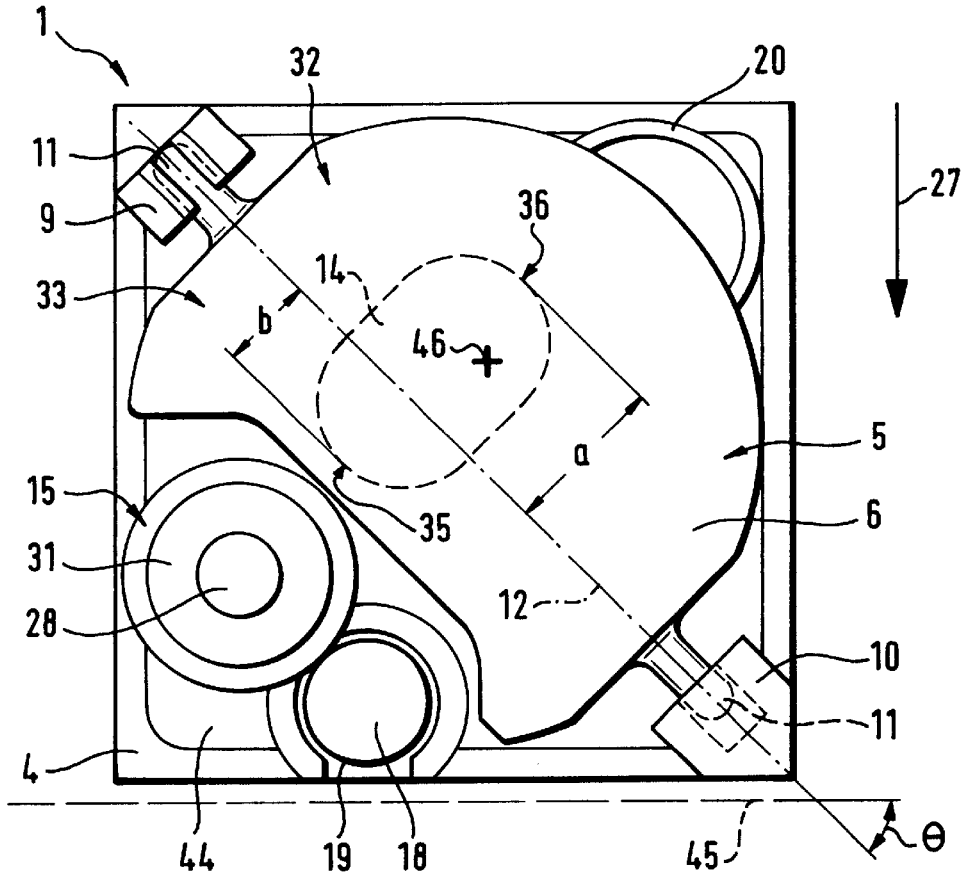

The invention relates to a display element for an electromagnet display device. Such display devices are normally formed by an array of display elements which collectively produce indicia or signs. They are used for numerous purposes, e.g. as destination signs in public transportation vehicles such as busses.

Each display element or "dot" generally has a disc which is mounted to a frame in such a manner that it can turn between two operating positions limited by stops of the frame. In a first of the operating positions an ON-side of the disc which normally has a yellow or white color (and in any case contrasts with respect to the background color of the display frame) is directed towards the viewing direction. In the second operating position the disc presents its OFF-side to the viewing direction which has essentially the same (non-contrasting) color as the background of the frame.

The disc of each display element is moved from its ON-position to its OFF-position and vice versa by an electromagnetic drive system comprising a permanent magnet attached to the disc and an electromagnet fixed to the frame. The disc operating position is determined by an electric current running through the coil of the electromagnet.

Display elements of the type to which the invention refers are subject to substantial development work with the aim to provide best possible visibility and reliable operation at least possible cost. An important factor with respect to this development work refers to the operation of the electromagnetic disc drive system. It is important to minimize the consumption of electric power, mainly where the displays are battery operated. To this end it is standard practice to use for the ferromagnetic core of the electromagnet a material which has a high magnetic remanence and simultaneously allows changing of the magnetic polarity in an electromagnetic field with relatively little electric power. Such a ferromagnetic core retains its magnetic field when the electric current in the surrounding coil is switched off. Therefore electric power is consumed only for changing the operating positions of the dots. No electric current is needed as long as the indicia which are to be displayed remain unchanged.

In most commercially available displays the electromagnetic drive system uses two electromagnets which are located in such a manner that the permanent magnet attached to the disc extends essentially along a line connecting two tips of the magnets having opposed polarity. This allows reliable operation, because in each operating position each of the poles of the permanent magnet is attracted by a closely located tip of an electromagnet which tip has an opposed polarity. Examples of this standard design are shown in U.S. Pat. No. 4,577,427 and EP 0731435 A1. This design, however, is costly, because on the one hand the high remanence material of the core of the electromagnet suitable for providing the above explained function is expensive and on the other hand the labour cost associated with making and assembling two coils is substantial.

There have been numerous efforts in the prior art to reduce this cost while simultaneously allowing reliable operation.

A simple possibility is to use a U-shaped ferromagnetic rod with only one coil. An example of this approach is shown in U.S. Pat. No. 5,005,305. It does, however, not achieve a cost reduction, because a large amount of the costly high remanence core material is needed and the assembly of the U-shaped electromagnet is difficult.

In another prior art design (shown for example in EP 0247045 B1) the display disc is shaped as a triangular flap which pivots about an axis running along an edge of the triangle. Here the magnet is positioned in the flap with its magnetic axis perpendicular to the surface of the flap. In one of the operating positions the magnet sits essentially on a tip of the ferromagnetic rod of the electromagnet. It is attracted thereby if the neighbouring poles are of different polarity and it is repulsed when the polarity of the electromagnet is switched over. This design, however, is limited to displays using the flap type triangular disc which is disadvantageous concerning other factors, such as production cost and visibility.

A further prior art approach to operate with only one electromagnet is shown for example in U.S. Pat. Nos. 4,914,427 and 5,055,832. Here a cylindrical permanent magnet is mounted on one of the pins about which the disc pivots. It has the shape of a thin cylinder centered on the pivoting pin and is magnetized transverse to the median plane of the disc. This design is suitable only for large sizes of displays such as highway signs. The assembly of the required parts is not feasible at tolerable cost for small signs which have surface areas of the discs of less than 3 $cm^2$ or even less than 2 $cm^2$.

On this basis the instant invention is concerned with the problem to provide a display element which allows reliable operation at reduced cost.

To this end the invention proposes a display element having a main viewing direction and comprising a frame and a disc mounted to the frame by means of a rotation bearing for pivoting of the disc about a pivoting axis, the pivoting axis running essentially in a display main plane which extends perpendicular to the main viewing direction, the disc having two differently colored sides, an ON-side the color of which contrasts against the background color of the frame and an OFF-side having a non-contrasting color, the bearing allowing pivoting of the disc about the pivoting axis between two operating positions, an ON-position where it rests against a first stop and its ON-side is directed towards the main viewing direction and an OFF-position where it rests against a second stop and its OFF-side is directed towards the viewing direction, an electromagnetic drive system for driving the disc from one of the operating positions to the other of the operating positions and comprising a permanent magnet attached to the disc and an electromagnet attached to the frame and having a high remanence core and a coil surrounding the core, wherein two portions of the disc extend in a disc plane on both sides of the pivoting axis, the permanent magnet is attached to the disc with its polar axis running essentially parallel to the disc and extending across the pivoting axis whereby its poles are located on differing sides thereof, the turning angle of the disc between the operating positions is less than 180°, the magnetic drive system has a single electromagnet and a driving tip of the ferromagnetic core is located sidewise of the pivoting axis such that in each of the operating positions one of the poles of the permanent magnet is directed towards the driving tip and the driving tip is in one of the operating positions rearward and in the other of the operating positions forward relative to the disc plane 38.

Experimental studies in the context of the instant invention have shown, that, by maintaining the mentioned conditions concerning the relative position of the disc, the permanent magnet and the electromagnet, a highly reliable operation of electromagnet display elements can be achieved with a single electromagnet which has a non-U-shaped, preferably straight, core. Thereby a substantial reduction of cost can be achieved, while maintaining the required operation and good visibility.

Further improvement of the operation is achieved by preferred features which are set forth in the subclaims and in the following detailed description of the invention. These preferred features can be used individually or in any suitable combination.

Figure 2:
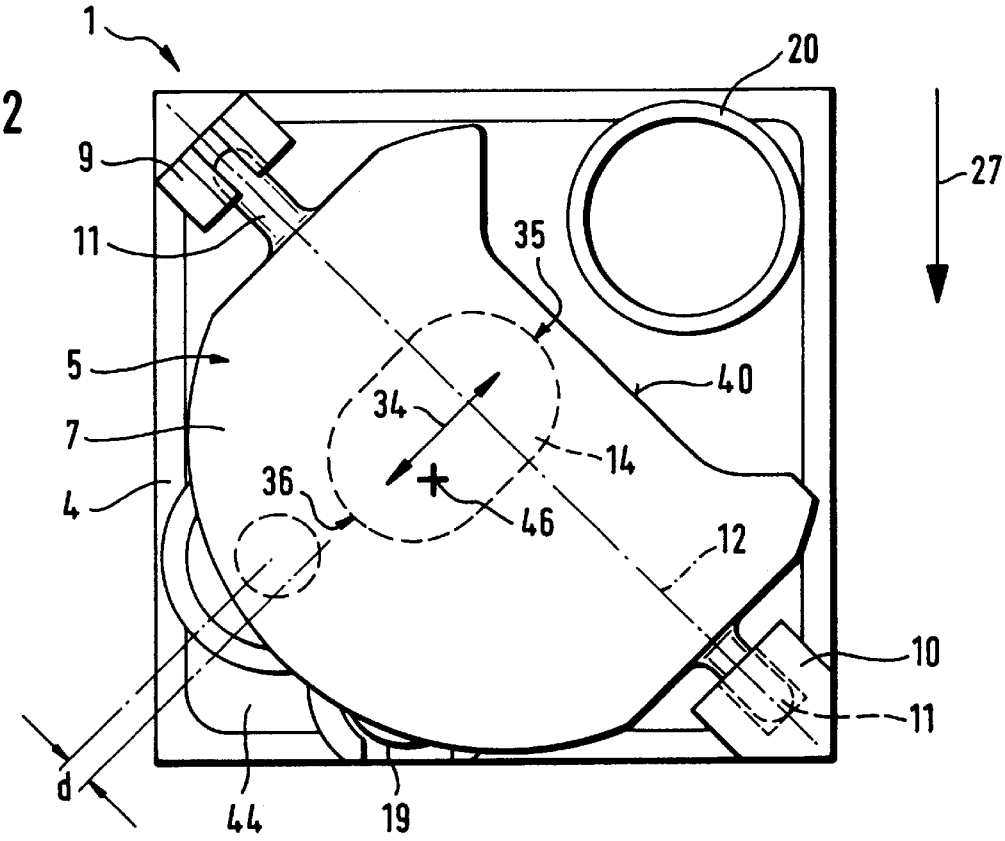
Figure 3:
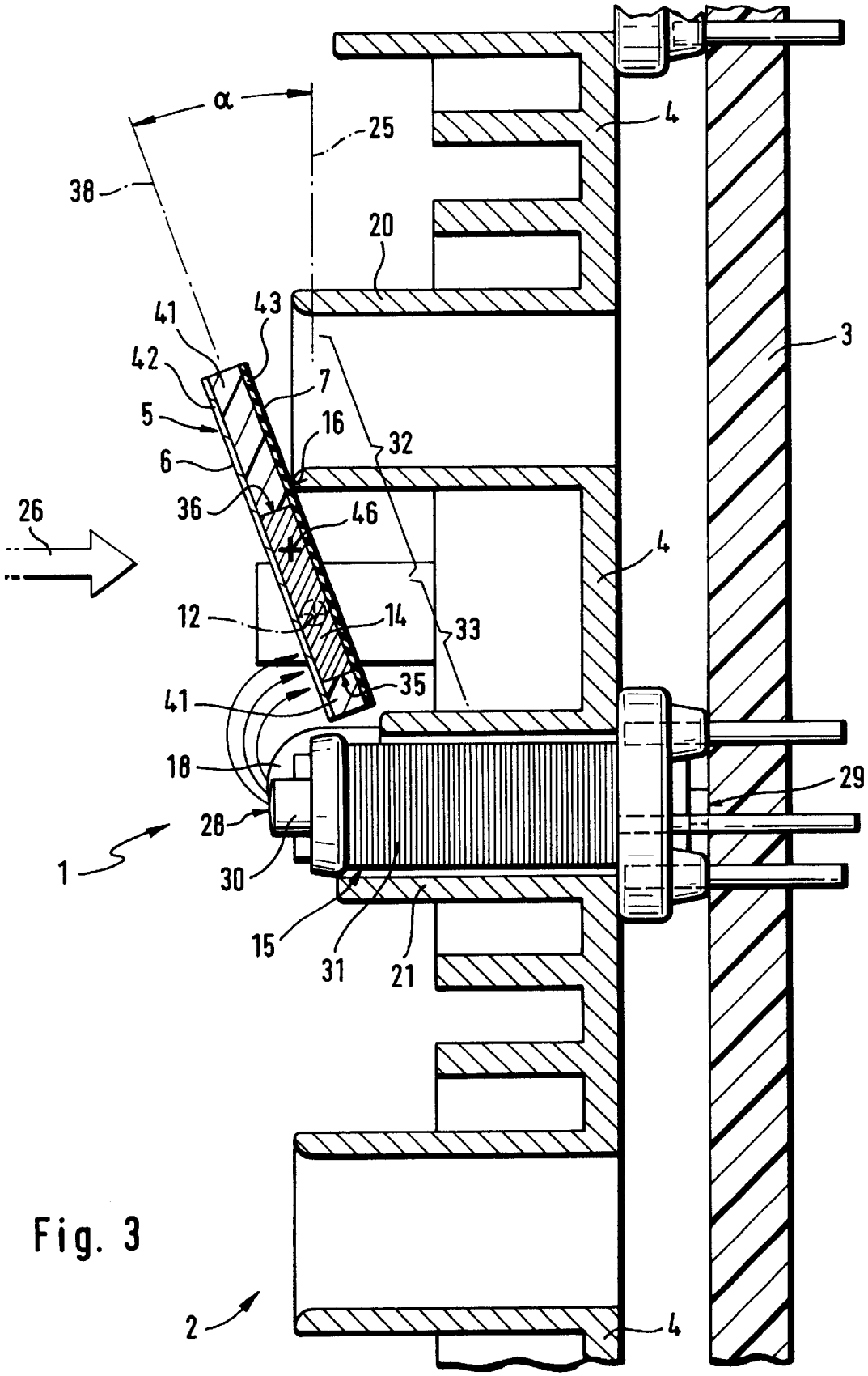
Figure 4:
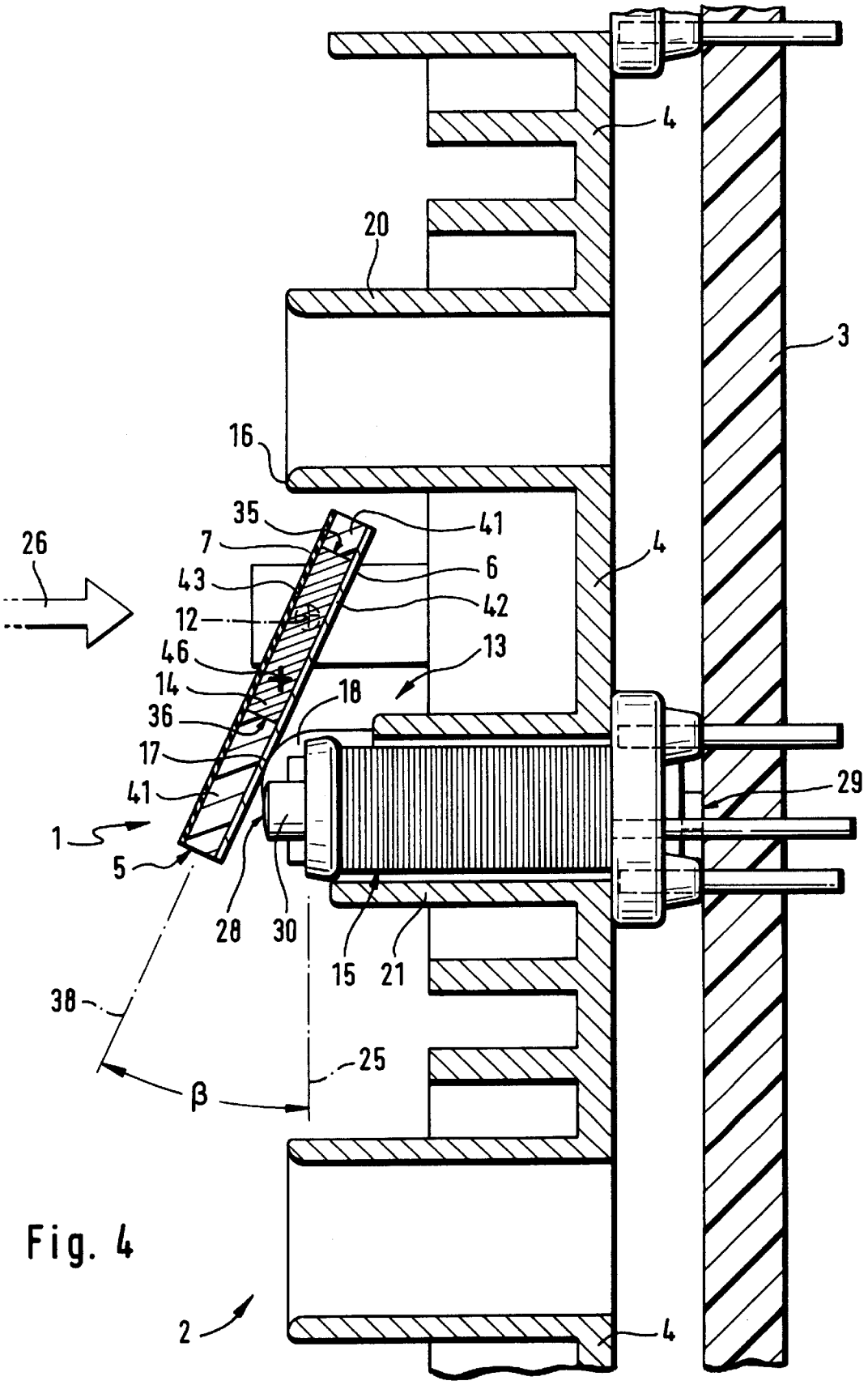

The invention is further explained with reference to a preferred embodiment represented in the drawings, wherein FIG. 1 shows a front plane view of a display element in the ON-position, FIG. 2 shows a front plane view of a display element in the OFF-position, FIG. 3 shows a cross-sectional view of the display element of FIG. 1, FIG. 4 shows a cross-sectional view of the display element of FIG. 2.

Display element 1 shown in the drawings forms a part of a display device 2 which comprises many display elements arranged in an array (normally in rows and columns) for collectively displaying indicia such as letters or numbers. Preferably a plurality of display elements 1 are mounted on a common printed circuit board 3 which simultaneously provides electrical connection and mechanical fixation of the display elements. Typically frames 4 of several display elements 1 are formed as a single piece of moulded plastic to provide a linear array of dots. This arrangement is known in the art and only schematically represented in FIGS. 3 and 4.

Each display element 1 has a disc 5 of thin generally flat shape with two sides, namely an ON-side 6 and an OFF-side 7. The frame 4 has a black or other very dark color providing the background color of the display device 2. The color of OFF-side 7 is so similar to the color of frame 4 that discs presenting their OFF-side to the viewer are practically not visible. ON-side 6 has a bright contrasting color whereby a dot in which the disc presents its ON-side is clearly visible.

In order to allow movement of the disc from its ON-position (shown in FIGS. 1 and 3) to its OFF-position (shown in FIGS. 2 and 4) rotation bearings 9,10 are provided. At least one of the rotation bearings (bearing 9 in the drawings) may be of a finger-type design which allows easy assembly of the disc 5 to the frame 4. It has two forwardly projecting fingers, each including an inner face opposite to the other one of the fingers and a bulbous portion formed on the inner face near the tip of the finger. Thereby a narrow entrance to a recess between the two fingers is provided. Elasticity of the fingers allows snapping insertion of a corresponding pin 11 of the disc into the bearing 9. Details about this preferred design may be taken from EP 0731435 A1 mentioned above.

Bearings 9,10 allow pivoting of the disc about a pivoting axis 12. This pivoting movement is driven by an electromagnet drive system 13 comprising a permanent magnet 14 attached to the disc 5 and an electromagnet 15. The pivoting movement of disc 5 is limited in both operating positions by respective stops 16,17. In the preferred embodiment shown the stop 17 in the OFF-position is provided by dome 18 of LED 19 which serves as light source for operation of the display in the dark. Stop 16 in the ON-position is provided by a plastic part 20 of the frame. In the case shown in the figures this part has for practical purposes a cylindrical shape similar to the cylindrical walls of a holder 21 by which electromagnet 15 is held.

A common plane in which the discs 5 of the display elements 1 of a display 2 lie is the display main plane. More strictly speaking the display main plane 25 is defined by the middle points of the pivoting axes 12 of discs 5. Viewing direction 26 is oriented perpendicular to display main plane 25.

Electromagnet 15 has a core 30 formed as a straight cylindrical rod and a coil 31 surrounding core 30. Core 30 has two tips, namely a forwardly oriented tip 28 located close to display main plane 25 and a rearwardly oriented second tip 29. The driving action of electromagnet 15 is mainly caused by the magnetic field in the vicinity of its forward oriented tip 28 which therefore is termed driving tip.

The electromagnetic drive system 13 of each display element 1 has only a single electromagnet 15. Nevertheless a reliable driving action is achieved mainly by maintaining the following conditions concerning the relative positioning and orientation of the system components.

Disc 5, unlike the triangular flaps of EP 0247045 B1, has two portions 32,33 extending (in disc plane 38) on both sides of pivoting axis 12. Polar axis 34 of permanent magnet 14 runs parallel to disc 5 (i.e. along disc plane 38) and extends across pivoting axis 12 such that its poles 35,36 are located on differing sides of axis 12. Preferably polar axis 34 extends essentially perpendicular to pivoting axis 12.

Furthermore it is important that the turning angle of the disc between the operating positions is less than 180°. In at least one and preferably both of the operating positions disc 5 is tilted relative to display main plane 25. The respective angles of inclination $\alpha$ and $\beta$ should preferably be at least about 5° each and in a most preferred practical embodiment the angle of inclination at in the ON-position is about 15°±5° and angle $\beta$ in the OFF-position is about 20°±5°. Generally the total pivoting angle of disc 5 should at most be 170°.

Magnet 15 is fixed to frame 4 in such a position that driving tip 28 of its core 30 is located sidewise of pivoting axis 12. In each of the operating positions one of the poles 35,36 of permanent magnet 14 is directed towards driving tip 28. In the ON-position shown in FIGS. 1 and 3 this condition applies to pole 35 and in the OFF-position shown in FIGS. 2 and 4 this applies to pole 36. Preferably polar axis 34 of permanent magnet 14 is oriented such that it intercepts the axis of core 30 of electromagnet 15. Small deviations d as shown in FIG. 2 are tolerable, but should be less than about 20% of the diameter of disc 5 at its pivoting axis 12 (e.g. less than ±2 mm in a case where the disc diameter at the pivoting axis is 10 mm).

In one of the operating positions driving tip 28 is rearward relative to that pole of permanent magnet 14 which is directed toward it. In other words driving tip 28 is in this operating position located rearward of disc plane 38 shown in FIGS. 3 and 4. In the other of the operating positions driving tip 28 is located forward relative to that pole which is directed toward it, i.e. it is located forward of disc plane 38. Here "rearward" and "forward" refer to positions below and above of disc plane 38 when looked along main viewing direction 26. In the shown preferred embodiment driving tip 28 is rearward of disc main plane 38 in the OFF-position and forward of disc main plane 38 in the ON-position.

In order to optimize the magnetic force of electromagnet 15 it is favorable to use a relatively thick coil 31 which extends almost along the complete length of core 30. Preferably tips 28,29 extending out of coil 31 have a total length (in the direction of the core axis) which is less than about 20% of the total length of the core. Simultaneously driving tip 28 and thus electromagnet 15 should be located rather close to pivoting axis 12. In order to allow pivoting of the disc without interference with the electromagnet and in particular to allow passage of disc 5 by coil 31 a corresponding cutout 40 is provided in disc 5. Thus, in that portion of disc 5 which moves rearward of pivoting axis 12 during the pivoting movement, disc 5 preferably has a nonsymmetrical shape where one of its portions 32 has a much larger surface area than the other of its portions 33. In such embodiment permanent magnet 14 may be attached to disc 5 in a nonsymmetrical manner the larger part a of its length extending into the larger portion 32 of disc 5 and the smaller part b of its length extending into the smaller portion 33 of disc 5. In the shown preferred embodiment LED 19 is located adjacent electromagnet 15 in the same (lower) sector 44 of frame 4 and cutout 40 accomodates LED 19 in addition to electromagnet 15.

Disc 5 is preferably made in a sandwich-design comprising a body part 41 which is preferably made of moulded plastic and at least one foil 42 covering the ON-side of the disc. Body part 41 is provided with pins 11 extending into rotation bearings 9,10. Foil 42 is made from a highly reflecting material. Preferably a second foil 43 of dark color covers the OFF-side of disc 5. Permanent magnet 14 is embedded in a corresponding recess of body part 41 and held in place by the covering foil (or foils). This design allows easy and inexpensive production of disc 5 with magnet 14 while maintaining essential requirements such as excellent rotation behaviour of pins 11 and high reflection of the ON-side of disc 5.

From the drawings it becomes apparent that the cutout 40 required for passage of disc 5 by electromagnet 15 is relatively large resulting in a substantial difference of the size of the two portions 32,33 of disc 5. This causes a substantial non-symmetry of the weight distribution of disc 5 with respect to pivoting axis 12.

A further effect of cutout 40 is that permanent magnet 14 is located non-symmetrically with respect to pivoting axis 12. As a result of this non-symmetry the distance between driving tip 28 of electromagnet 15 and poles 35,36 of permanent magnet 14, is substantially different in the two operating positions as becomes readily apparent by comparing FIGS. 3 and 4. In the ON-position shown in FIG. 3 this distance is much larger than in the OFF-position. Evidently the difference in distance causes a corresponding difference of the driving force effected by electromagnet 15 in the two operating positions.

According to a preferred embodiment of the invention favorable use of a non-symmetrical weight distribution of disc 5 with respect to pivoting axis 12 is made by using the force of gravity for supplementing movement of disc 5 from one of its operating positions (preferably the ON-position) to the other of its operating positions (preferably the OFF-position).

To this end display 2 is mounted such that its main plane runs in an upright direction, such that the force of gravity (or at least a component thereof) acts in the direction of the display main plane as shown symbolically by arrows 27 in FIGS. 1 and 2. Main plane 25 does not have to be strictly vertical, but can be inclined to some extent within limits which can be determined experimentally. Pivoting axis 12 runs in a direction which has a horizontal component. In other words, angle θ (FIG. 1) between pivoting axis 12 and a horizontal plane 45 is less than 90°. The smaller angle θ is, the higher is the supplement by gravity of a movement of disc 5 from the ON-position of FIGS. 1 and 3 to the OFF-position of FIGS. 2 and 4. Practical experiments have shown, that an optimum value of angle θ is about 45°. In any case values of θ between 20° and 70° are preferred.

In view of the non-symmetrical weight distribution the center of mass of disc 5 which is shown symbolically by cross 46 is located at a distance from pivoting axis 12. Thus, in one of the operating positions (preferably the ON-position) it is located higher than in the other of the operating positions (preferably the OFF-position).

As a result of these measures gravity causes a torque which supplements movement of disc 5 from the ON-position to the OFF-position. On the other hand, as noted above, electromagnet 15 is located at the lower sector 44 of frame 4 with respect to pivoting axis 12 and its force is higher in the OFF-position. Thus, gravity supplements movement in the direction where the magnetic force is lower whereas in the reciprocal direction a high magnetic force is available for returning disc 5 against the force of gravity into the upper (ON)-position.

What is claimed is:

1. Display element for an electromagnetic display device said display element having a main viewing direction and comprising a frame and a disc mounted to the frame by means of a rotation bearing for pivoting of the disc about a pivoting axis, the pivoting axis running essentially in a display main plane which extends perpendicular to the main viewing direction, the disc having two differently colored sides, an ON-side the color of which contrasts against the background color of the frame and an OFF-side having a non-contrasting color, the bearing allowing pivoting of the disc about the pivoting axis between two operating positions, an ON-position where it rests against a first stop and its ON-side is directed towards the main viewing direction and an OFF-side position where it rests against a second stop and its OFF-side is directed towards the viewing direction, an electromagnetic drive system for driving the disc from one of the operating positions to the other of the operating positions and comprising a permanent magnet attached to the disc and an electromagnet attached to the frame and having a high remanence core and a coil surrounding the core, wherein, two portions of the disc extend in a disc plane on both sides of the pivoting axis, the permanent magnet is attached to the disc with its polar axis running essentially parallel to the disc and extending across the pivoting axis whereby its poles are located on differing sides thereof, the turning angle of the disc between the operating positions is less than 180°, the electromagnetic drive system has a single electromagnet with a straight ferromagnetic core and a driving tip of the straight ferromagnetic core is located sidewise of the pivoting axis such that in each of the operating positions one of the poles of the permanent magnet is directed towards the driving tip and the driving tip is in one of the operating positions rearward and in the other of the operating positions forward relative to the disc plane.

2. Display element according to claim 1, wherein the disc has a cutout in its portion which moves rearward of the pivoting axis when the disc pivots between the two operating positions, the cutout allowing pivoting of the disc without interference with the electromagnet.

3. Display element according to claim 2, wherein the coil of the electromagnet extends along the major part of the ferromagnetic core and the cutout is so shaped and sized that it allows passage of the disc by the coil.

4. Display element according to claim 2, wherein a light source is located next to the electromagnet and the cutout is so shaped and sized that it allows passage of the disc by the electromagnet and the light source.

5. Display element according to claim 1, wherein the permanent magnet is embedded in the disc.

6. Display element according to claim 1, wherein the disc comprises a body part having two pivoting pins extending into the rotation bearing, the body part being covered on at least the ON-side by a foil, the foil having the contrasting color on its surface directed away from the body part.

7. Display element according to claim 6, wherein the body part is a moulded plastic part.

8. Display element according to claim 1, wherein the disc has a substantially non-symmetrical weight distribution with respect to the pivoting axis, the display main plane runs in an upright direction, the pivoting axis runs in a direction which has a horizontal component, the single electromagnet is located at the lower sector of the frame with respect to the pivoting axis, and the center of mass of the disc is higher in a first operating position than in a second operating position whereby gravity causes a torque which supplements movement of the disc from the first operating position towards the second operating position.

9. Display element according to claim 8, wherein the first operating position is the ON-position and the second operation position is the OFF-position.

10. Display element according to claim 8, wherein the pivoting axis runs at an angle of at least 20° and at most 70° with respect to a horizontal plane.

11. Display element according to claim 1, wherein the angle of inclination of the disc relative to the display main plane in at least one of the operating positions is at least about 5°.

12. Display element according to claim 1, wherein the angle of inclination of the disc in both operating positions is at least about 5°.

13. Display element according to claim 1, wherein the angle of inclination of the disc in the ON-position is about 15°±5°.

14. Display element according to claim 1, wherein the angle of inclination of the disc in the OFF-position is about 20°±5°.

15. Display element according to claim 1, wherein the permanent magnet is located non-symmetrically with respect to the pivoting axis of the disc.

16. Display element according to claim 1, wherein the distance between the driving tip of the electromagnet and the poles of the permanent magnet is larger in the ON-position than in the OFF-position.

17. Display element according to claim 16, wherein the distance is substantially larger.

* * * * *